United States Patent [19]

Globus

[11] 3,979,302

[45] Sept. 7, 1976

[54] OIL AND GASOLINE FIRE EXTINGUISHING COMPOSITION AND METHOD OF MAKING

[75] Inventor: Alfred R. Globus, Bayside, Long Island, N.Y.

[73] Assignee: Guardian Chemical Corporation, Hauppauge, N.Y.

[22] Filed: Mar. 19, 1974

[21] Appl. No.: 452,603

[52] U.S. Cl. ..... 252/2; 252/118; 252/548

[51] Int. Cl.[2] ..... A620 1/00

[58] Field of Search ..... 252/2, 118, 548

[56] References Cited

UNITED STATES PATENTS 3,758,641 9/1973 Zweigle ..... 252/2 X

*Primary Examiner*—Stephen J. Lechert, Jr.

[57] ABSTRACT

Compositions comprising a polymerized (hydrated amide-amine complex), a method of making the same, fire extinguishing compositions containing the same as active agent and a method for extinguishing fires therewith.

16 Claims, No Drawings

OIL AND GASOLINE FIRE EXTINGUISHING COMPOSITION AND METHOD OF MAKING

This invention relates to a polymerized complex which may be employed in extinguishing hydrocarbon fires and in particular fires involving burning kerosene, gasoline, jet engine fuels, heavy oils such as (rude oil, heavy fuel oil and bilge residue.

A serious problem has existed for some time with regard to hydrocarbon fires resulting from the ignition of spillage from tankers, bilge pumps, oil drilling rig waste and spillage, power plant waste and effluent and the contents of damaged or sunken tankers as well as fires resulting from aircraft, marine and auto mishaps. Many different and varied compositions have been proposed and are presently in use for extinguishing hydrocarbon fires. Most, however, suffer from the drawback that they must be applied as a concentrated viscous foam thereby presenting problems of application and control in addition to their questionable efficacy.

Many of the foams now employed operate on the basis of their detergent powers. This group of foams generally fall into the ionic class, with anionics of the sulfonated alkyl benzene variety predominating. These materials have a major advantage in that they are low in cost, however they suffer from the insurmountable disadvantage that their dispersing properties only act to break up the hydrocarbon oil temporarily thereby forming an unstable emulsion which quickly agglomerates and reforms the original burning oil mass.

In addition to this major reformation problem, the use of anionic detergents has been found to be unsatisfactory since they produce profuse foam and suds and in many cases are toxic, corrosive, inflammable and/or non-biodegradable.

It is, therefore, an object of the invention to provide a novel means of extinguishing hydrocarbon fires.

It is a further object of the invention to provide a novel means of extinguishing such fires on the surface of bodies of water. It is another object of this invention to provide a novel fire extinguishing agent, particularly well-adapted for use in connection with burning oil and/or solid hydrocarbon materials especially when the same are present on water.

It is still a further object of this invention to provide a novel composition containing the novel fire extinguishing means thereof.

Other and additional objects will become apparent from a consideration of this entire specification, including the claims hereof.

The instant agent which can be characterized as a poly(complex)$_n$ is capable when present in only a 3% solution of extinguishing a major fuel oil or gasoline fire in about one-half the time it takes foam type agents to accomplish the same job. In some cases because of the physical conditions present the agent of the invention will work effectively where foam would be impracticable. The instant fire extinguishing agent may be applied using standard fire-fighting equipment employing a regular fog-nozzle. The agent is effective to extinguish a fire of gasoline, fuel oil or jet fuel origin with a minimum of manpower and water, reducing the danger to the fire fighters and subsequent damage caused by the persistent nature of the conventional foams.

As has already been noted the agent of the instant invention does not work on a foam principle, but rather is believed to make water capable of forming a temporary combination or further a complex with the hydrocarbon which thus becomes non-flammable. Thus in accordance with the invention it has been found that a 3% solution of the poly(complex)$_n$ is capable of forming a water:hydrocarbon complex usually ranging from 1.3 active agent:64 water:35 hydrocarbon to as high as 1.5:74:25. These complexes are non-flammable because of the water held in the complex and, as long as the complex remains stable, the gasoline, oil, etc. can be only be reignited with great difficulty if at all. For this reason the novel agent of the invention in the form of its water solution on hitting the flame in the form of small droplets, combines almost instantly with both the highly flammable vapors and the surface of the fuel and smothers the flame. No longer is a constant supply of readily ignitable fuel available to the fire, but only the complex of the invention which is incapable of burning, and the vapors of the burning liquid fuel, now trapped as a relatively non-volatile fluid. Further the gasoline and/or oil no longer floats on the water, the instant agent plus the hydrocarbon together with the mechanically entrapped air is lighter than the rest of the liquid and floats on the top thereof as a blanket.

Unlike foam there is no messy residue to contend with nor are there any problems with degradation during storage because also unlike protein foam the instant agent is completely stable on standing and can by the mere addition of a small amount of a stabilizer be stored in the form of a 3% solution thereof in a pressure system which on release is capable of protecting gasoline or oil storage tanks, refineries, etc.

The instant agent enjoys the following desirable advantages over the known hydrocarbon fuel fire extinguishing agents: Extinguishes fires in one-half the time of foam or less; can be premixed enroute to the fire or readied for instant application with eductor and regular equipment; extinguishment in one-half the time permits the use of one-half as much additive and one-half as much water; stability on storage; indefinite shelf life; can be provided in the form of a highly concentrated product, i.e., 30 gallons of complex are recommended for premixing with water for forming 1,000 gallons of solution; inerts as it extinguishes thereby greatly reducing the danger of reignition non-toxic to personnel in either concentrated or diluted form; hazzard free handling; non-corrossive; no fire hazzard (flash point of concentrate 370°F); and non-volatile.

The instant poly(complex)$_n$ has the added important capability of use in the same 3% dilution for cleaning up oil, gasoline, jet fuels and other hydrocarbon spills. This is of tremendous value to fire departments called to the scenes of an accident, tank truck overturns, storage tank leaks, etc. However, it is not intended to permanently render inert such products, thus application of a solution of the poly(complex)$_n$ to the surface of a burning tankful of product will extinguish the blaze by rendering its surface non-combustible but will not affect the remaining fuel or its financial value. This can be of particular importance to fire training centers that constantly reuse a large pitfull of fuel oil for training purposes.

Broadly speaking the invention resides in the provision of a novel fire extinguishing agent comprising a poly(complex) of a hydrated condensation reaction of a mono- or dialkanol amine with a higher fatty acid.

According to this invention, the amine reactant may contain about 1 to 6 carbon atoms, preferably in straight chain configuration, but isomeric branch chains may be present. Either a single amine or a mixture of amines mixed both as to chain length and as to mono- or dialkanol amine configuration can be used in the preparation of the poly(complex) precursor hereof. The fatty carboxylic acid reactant may be naturally occurring or synthetically produced and suitably contains at least about 8 carbon atoms in branched, but preferably straight, chain configuration. It is preferred to employ carboxylic acids having about 8 to 16 carbon atoms, although higher carbon chain length carboxylic acids can be used, sometimes to great advantage. The acids may be used individually or in mixtures and may be saturated or unsaturated.

Operative fatty acids include both the saturated and unsaturated fatty acids containing 8 or more carbon atoms. Illustrative of such acids are the following:

Caprylic
Capric
Lauric
Myristic
Palmitic
Stearic
Arachidic
Behenic
Δ-Decylenic
Δ-Dodecylenic
Palmitoleic
Oleic
Ricinoleic
Petroselinic
Vaccenic
Linoleic
Linolenic
Eleostearic
Licinic
Parinaric
Gadoleic
Arachidonic
Cetoleic
Erucic, and
Selacholeic, lauric acid being preferred.

Operative amine reactants include the primary, secondary and tertiary aliphatic amines such as Methylamine
Dimethylamine
Trimethylamine
Ethylamine
Diethylamine
Triethylamine
n-Propylamine
Di-n-propylamine
Tri-n-propylamine
n-Butylamine
n-Amylamine
n-Hexylamine
Laurylamine
Ethylenediamine
Trimethylenediamine
Tetramethylenediamine
Pentamethylenediamine
Hexamethylenediamine
Ethanolamine
Diethanolamine
Triethanolamine The amine-acid condensation reaction is suitably carried out at a temperature which is high enough to drive substantially all of the condensate water out of the system. Reaction temperatures of about 150°C or higher have been found to be suitable. It is necessary that the temperature selected be above the boiling point of water in order that the water be split off in the required degree. The condensation raction is preferably carried out with a reactant mole ratio of about two moles of amine per mole of acid. The reaction is carried out for a time sufficient to utilize substantially all of the amine reactant. It is possible to continue the reaction until the reaction mass contains up to about 2 to 30 weight % free amine and little or no free acid.

The condensation reaction product complex precursor comprises a mixture of amides and amines.

The amide-amine precursor used in accordance with this invention will have a melting point which is, to a great extent, dependent upon the acid content thereof. Thus, if capric or lauric acids are reacted with ethanol amine, the product has a melting point of about 15°C. Since it is desirable to utilize the product hereof in liquid form, if possible, a relatively small amount of longer chain acids can be incorporated whereby the product melting point can be reduced. Thus, for example, if ethanol amine is reacted with acids such that the acid content of this product is about 80% $C_8$ to $C_{12}$ and about 15% $C_{18}$, the melting point thereof is about 5°C, which, for many applications, is quite desirable.

The thusly prepared complex-precursor reaction product consists predominantly of mono and dialkanol amides and, to a minor extent, of 2 to 30 wt. % of free amine, and is non-ionic in character.

The aforesaid condensation product is thereafter, in a second step, subjected to hydration. At least 7% referred to the weight of the condensation product and preferably 10% or more of water are used in this hydration. As a result of the hydration, there is formed a clear, smooth, flowable liquid having a viscosity of 500 cp.

The above hydrated condensation product complex composition is then subjected to conditions conducive to the polymerization thereof. Ordinarily due to the nature of the above formed pre-polymerized complex, autopolymerization thereof will take place upon standing or storing at slightly elevated temperatures, i.e., 25° to 30°C. The process may be accelerated by heating at about 50° to 60°C.

The aforedescribed polymerization of the condensation product causes the chain length thereof to increase, thereby increasing the viscosity of the thus produced polycomplex.

It is this hydrated product, poly(complex) precursor which is thereafter formed into the poly(complex) which is characterized by the properties required to be operative and effective in extinguishing hydrocarbon fires as discussed above. It is important to note that the hydration step is not the reverse of the condensation step and that, accordingly, the hydrated product is not a mixture of fatty acids and amines.

The final product which can be considered a poly(hydrated amide-amine complex), constitutes the novel material of the invention and is characterized by the properties necessary in connection with the aforementioned applications.

The polycomplex further readily complexes with oil, is 99% biodegradable, is lighter than sea water and is not salted out by the 3% salt content of sea water. The polycomplex material is usable per se to extinguish hydrocarbon fires, due to its rather high viscosity, e.g., in the 500 to 750 centipoise range.

In accordance with a preferred embodiment of the invention, the condensation-reaction product obtained by heating the fatty acids and ackanolamine is admixed with 1–3% of a fatty acid amine soap, such as lauric acid amine soap (i.e. diethanolamine laurate), oleic acid amine soap, stearic acid amine soap, etc. but preferably lauric acid amine soap and/or with a water-miscible solvent, such as cellosolve or carbitol. Thereafter, the hydration is carried out using at least 7% of water referred to the condensation-reaction product and the resultant precursor is allowed to polymerize to form the instant poly(complex).

The use of the water-miscible solvent is associated with numerous advantages, among which the following may be mentioned: Increase in the ease of hydration, aid in the adjustment of the viscosity, aid in the adjustment of hydrophobic-hydrophilic ratio of precursor product, and aid in forming of the precursor prepolymerized complex. In order to take advantage of the excellent fire extinguishing properties of the poly(amide-amine)complex material of this invention, a composition containing this poly(complex) material and other components has been developed. This composition is suitably an aqueous solution containing about 3 wt. % and preferably no more thereof of the poly(complex) and may additionally contain minor amounts of complexing adjuvants such as foam suppressors, for example, dialkylsiloxane polymers and polysiloxane polyalkylene glycol ester copolymers and preferably about 0.1 to 0.2 wt. % polydimethylsiloxane, viscosity regulators such as carbitols, e.g., methyl, ethyl or butylcarbitol, preferably about 2 to 10 wt. % of butylcarbitol, coalescence retardants, such as polyether adducts of alkyl phenols, preferably about 2 to 10 wt. % of at least one reaction product of n-octyl-phenol and about 6 mols of ethylene oxide, etc.

The poly(complex)$_n$ material of this invention has a specific gravity which is between that of fresh and sea water, it being slightly heavier than fresh water and substantially lighter than sea water. It is slowly, but greatly soluble in water and has a strong affinity for and solubility in hydrocarbons. This material is substantially non-toxic and non-irritating to humans or animals. When applied has a 10% aqueous solution, $LD_{50}$ in rabbits is greater than 20 grams per kilogram. A 5% solution of this material placed in the eyes of rabbits showed no irritational effect even after 4 days.

The poly(complex) of the invention is miscible in all proportions with water without any clouding or hazing. This is particularly important in connection with its ability to adequately operate from existing fire extinguishing equipment.

The poly(complex) is further characterized by the advantageous properties of being biodegradable.

Any problem which arrise coincident to its storage as, for example, under proper conditions where refrigeration is not available, can be avoided by the addition of an anti-microbial agent to the complex material. An instance of a suitable anti-microbial for this purpose is tribromosalicylanilide.

For commercial use, the product as noted above may be sold per se or in the form of its aqueous solutions, either concentrated or dilute, i.e., about 3%.

The poly(complex) may be stored as such in the concentrate form and diluted prior to use, or it may be premixed with water and other above-noted materials and then used directly.

The following Examples are given in order to illustrate the invention and are in nowise to be construed as a limitation thereof.

EXAMPLE I 200 g lauric acid (1 mol) and 210 g diethanol (2 mols) are reacted at a temperature of about 160°C, for a time sufficient that the water resulting from the reaction is driven off. A heavy viscous product results, its viscosity amounting to 600 centipoise.

The aforesaid reaction product is mixed with 1% by weight of lauric acid-amine soap (diethanol amine laurate), 0.1–0.2% by wt. of dimethylpolysiloxane and 10% of butylcarbitol. Water is added in an amount corresponding to 10% referred to the amount of the reaction product and hydration of the mixture carried out. The resultant complex is then heated to about 50° to 60°C whereupon the same autopolymerizes.

The resulting product has low sudsing properties, is 99% biodegradable and is non-toxic. As produced in the concentrated form, the product has a fairly high viscosity. The addition of 50% by wt. of water thereto produces a product which can be readily sprayed and is stable indefinitely.

EXAMPLE II

The procedure of Example I is followed except that the complex precursor is allowed to autopolymerize by being aged for 180 days at 25°C.

EXAMPLE III

The procedure of Example I is followed excepting that the precursor complex is polymerized by storage at 80°C for 250 minutes. The properties of the product obtained are set out in the following Table.

Table A

| | |
|---|---|
| Form | somewhat viscous liquid |
| Color | light orange |
| Odor | citrus-like |
| Specific Gravity | 1.0 |
| Solubility in Water | complete |
| pH of a 1% solution | 9.6 – 9.9 |

EXAMPLE IV

The above produced poly(complex)$_n$ may be employed as follows:

The spray should be adjusted to a fine spray, and the so-called "fog nozzle" gives a satisfactory spray pattern. This should be directed at a slight angle toward the base of the flame in order to complex the surface as quickly as possible. If directed upwards at the flame, it may have little or no value since it cannot complex the fuel feeding the fire. A high pressure fog nozzle with a 3% solution of the instant poly(complex)$_n$ and with the spray at the correct angle to the surface should extinguish the flame extremely rapidly.

When adding the poly(complex)$_n$ to water in a tank or tanker, the solution should be thoroughly circulated to insure uniformity.

EXAMPLE V

The effectiveness of the instant poly(complex)$_n$ over protein-foam has been demonstrated in standard fire tests. Solutions thereof were compared to water applied by means of a fog-nozzle, and to protein-foam and with a 3% solution thereof, typical results were as follows, as tested on a gasoline/light oil fire of high intensity conducted in a pit:

| | |
|---|---|
| Protein-foam | extinguished in 1 min. 24 sec. |
| Composition of Ex. I in 3% | extinguished in 0 min. 35 sec. |

and finally, using a turbo-jet nozzle on a second test, the fire was extinguished in only 7 seconds.

On a railroad car, immersed partially in a Diesel fuel oil bath and sluiced with oil by a pressure pump, two 1½ inch hose lines, each manned by four firefighters, normally would bring the fire under control in about 12–15 minutes, but, with one 1½ inch hose line and two men, adding 3% poly(complex)$_n$ to the water, the fire was extinguished in 4 minutes and 10 seconds.

In another test, a 12 foot diameter pool of water, approximately 12 inches deep was covered with 6 inches to 8 inches of fuel oil and ignited. After the flames had reached maximum intensity, a stream of plain water from a fire-hose, was directed at the center of the fire, dividing the latter into two segments. Playing the water on one segment alone, the flames were brought down to lowered activity and the hose was now played on the other section of the fire. Within 10 seconds after the water was turned away from the first section, the fire in this area had now increased to maximum intensity again, demonstrating that water alone was unable to control this fire.

When this was repeated with water containing 3% of the instant poly(complex), the first section was quickly brought down to a limited number of small flames, but when the hose was turned on to the fire on the second section, the flames in Segment One continued at the same low level without sign of increased activity. The fire in Segment Two was now extinguished in about 20 seconds and the hose was turned back to Segment One (where the fire was actually continuing to decrease) and the remaining fire extinguished in 5 seconds.

Attempts to reignite the fire by means of a small gas torch were not successful. Only by pouring additional gasoline upon the surface of the liquid and igniting this, was the fire gradually restored and then quickly re-extinguished by applying the instant poly(complex).

It is to be understood that while the instant poly(-complex) has been found to be particularly effective for extinguishing fires of hydrocarbon origin, its pronounced wetting ability, its adhesive properties and its complexing action upon organic gases released from the charring of wood, make the 3% solution thereof useful in combating Class "A" fires as well.

Alcohols are rapidly rendered non-flammable thereby (3%); ethers and many other organic compounds, including fats and oils of plant, animal or fish origin are also complexed by the above solutions, thereby enabling fires on such materials to be controlled therewith.

It is to be understood that the instant poly(complex) may be employed in the aqueous solution referred to above by means known in the art for treating fires. The method of application thereof to the fire will in part be controlled and/or determined by the type of fire involved and the environment thereof. The instant poly(-complex) may be hosed onto a fire through ordinary pressure equipment using standard nozzles. It may also be applied under pressure by means of aerosol containers and the like.

Since it is obvious that numerous changes and modifications may be made to the instant invention, without departing from the scope and intent thereof, any such changes are deemed to be within the spirit thereof.

I claim:

1. A composition comprising a polymerized (hydrated amide-amine)complex formed from at least one fatty acid having 8 to 18 carbon atoms and at least one dialkanol amine having 1 to 6 carbon atoms per alkanol group.

2. A composition as defined in claim 1 wherein said complex contains from 2 to 30 weight percent of free amine.

3. A composition as defined in claim 1 wherein said dialkanol amine is diethanol amine and said acid is selected from the group consisting of $C_{8-18}$ acids.

4. A composition as defined in claim 1 wherein said dialkanol amine is diethanol amine and said acid is lauric acid.

5. A composition as defined in claim 1 wherein said acid is a mixture of fatty acids.

6. A composition as defined in claim 1 additionally containing at least one member selected from the group consisting of fatty acid amine soaps, water miscible solvents, dialkyl siloxane polymers, polyether adducts of alkyl phenols and antimicrobials.

7. A composition as defined in claim 6 wherein said fatty acid amine soap is diethanol amine laurate, said solvent is cellosolve and said siloxane polymer is polysiloxane polyalkylene glycol ester.

8. A composition as defined in claim 7 wherein said polymer is polydimethyl siloxane and said cellosolve is 2-ethoxy ethanol.

9. A composition as defined in claim 1 additionally containing a polyether adduct of n-octyl phenol and about 6 mols of ethylene oxide.

10. A process of preparing the composition as defined in claim 1 comprising heating a mixture of said fatty acid and said dialkanol amine in a mol preparation of about 2 mols of amine per mol of acid, hydrating the reaction product thereof by the addition of at least 7% by water thereto and thereafter subjecting said hydrated product to conditions conducive to autopolymerization thereof to form a poly(complex).

11. A process as defined in claim 10 wherein said heating is carried out at a temperature of at least 150°C.

12. A process as defined in claim 10 wherein said hydration is carried out with from about 7 to about 10% by weight of water.

13. A process as defined in claim 10 wherein said polymerization is accomplished by storing said hydrated product at an elevated temperature.

14. A process as defined in claim 10 wherein said polymerization is accomplished by heating said hydrated product at a temperature of from about 50° to about 60°C.

15. A process as defined in claim 10 wherein said polymerization is accomplished by allowing said hydrated product to autopolymerize at ambient temperature.

16. A fire extinguishing composition comprising 3% of a liquid solution of the composition as defined in claim 1.

* * * * *